US007819093B2

(12) United States Patent
Yamashita et al.

(10) Patent No.: US 7,819,093 B2
(45) Date of Patent: Oct. 26, 2010

(54) ENGINE HYDRAULIC CONTROL APPARATUS

(75) Inventors: Yoshio Yamashita, Toyota (JP); Hideo Kobayashi, Mishima (JP); Katuhiko Arisawa, Gotenba (JP); Kenichi Yamada, Yaizu (JP); Kunihiko Hayashi, Ashigarakami-gun (JP)

(73) Assignee: Toyota Jidosha Kabushiki Kaisha, Aichi-Ken (JP)

( * ) Notice: Subject to any disclaimer, the term of this patent is extended or adjusted under 35 U.S.C. 154(b) by 380 days.

(21) Appl. No.: 12/090,188

(22) PCT Filed: Oct. 13, 2006

(86) PCT No.: PCT/JP2006/320893

§ 371 (c)(1),
(2), (4) Date: Apr. 14, 2008

(87) PCT Pub. No.: WO2007/043711

PCT Pub. Date: Apr. 19, 2007

(65) Prior Publication Data

US 2009/0229561 A1 Sep. 17, 2009

(30) Foreign Application Priority Data

Oct. 14, 2005 (JP) ..... 2005-300644

(51) Int. Cl.
*F01P 1/04* (2006.01)

(52) U.S. Cl. ..... 123/41.35; 123/196 R

(58) Field of Classification Search ..... 123/41.34, 123/41.35, 196 R, 196 M, 196 CP; 184/6.5
See application file for complete search history.

(56) References Cited

U.S. PATENT DOCUMENTS

| | | | | |
|---|---|---|---|---|
| 4,204,487 | A * | 5/1980 | Jones | 123/41.35 |
| 5,339,776 | A * | 8/1994 | Regueiro | 123/196 CP |
| 2002/0083915 | A1 | 7/2002 | Choi | |

FOREIGN PATENT DOCUMENTS

| | | | |
|---|---|---|---|
| JP | 57-89810 | | 6/1982 |
| JP | 2-34404 | Y2 | 9/1990 |
| JP | 07-259525 | A | 10/1995 |
| JP | 08-093430 | A | 4/1996 |
| JP | 9-88533 | A | 3/1997 |
| JP | 2002-221016 | A | 8/2002 |
| JP | 55-135112 | | 4/2008 |

OTHER PUBLICATIONS

Toyota Technical Publication No. 15657, Apr. 28, 2004, pp. 117-118.

* cited by examiner

*Primary Examiner*—Noah Kamen
(74) *Attorney, Agent, or Firm*—Sughrue Mion, PLLC

(57) ABSTRACT

A hydraulic control apparatus (1) is provided with an oil pump (4) that draws oil from an oil pan (3) due to the rotation of the crankshaft, a piston jet (6) that open when the hydraulic pressure of the oil that has been drawn from this oil pump (4) attains a valve opening pressure Qa and injects oil toward a piston through an oil injection path (5), a relief valve (8) that is disposed on an oil return path (7) and opens when the hydraulic pressure of the oil that has been drawn by the oil pump (4) has attained a valve opening pressure Qb, and a switching valve (9) that is disposed on the oil return path (7). The valve opening pressure Qb is set to a pressure that is lower than that of the valve opening pressure Qa.

2 Claims, 6 Drawing Sheets

ENGINE HYDRAULIC CONTROL APPARATUS

TECHNICAL FIELD

The present invention relates to engine hydraulic control apparatuses that can appropriately control the hydraulic pressure of an engine.

BACKGROUND ART

Inside an engine, oil for lubrication, which is stored in an oil pan, is drawn and feed by an oil pump, and an oil passage for supplying lubricant to each of the lubricated parts is formed. In addition, an oil relief passage is connected to the oil passage downstream of the oil pump, and the oil relief passage is provided with an oil relief valve that opens when the pressure (hydraulic pressure) inside the oil passage that accompanies the feeding of the oil by the oil pump becomes equal to or greater than a set pressure. The excess oil returns to the oil pan, and the maximum hydraulic pressure in the oil passage is thereby regulated.

In connection with this, an oil pump has been proposed in which, during a low temperature startup, when the viscosity of the oil becomes high, the load that is applied to the oil pump is reduced by increasing the oil relief from the oil passage, and thereby an improvement in the startup characteristics is realized (Patent Document 1).

Specifically, when the engine is started up, a flywheel is rotated by a starter motor, and the flywheel must reach a minimum rotating speed that enables the engine to be started-up. However, because the viscosity of the oil becomes high when the temperature is low, the load that is applied to the oil pump increases because the flow resistance of the oil that is flowing through the oil passage increases, and this acts as a reactive force against the starter motor drive power. Thus, the flywheel cannot be made to reach the minimum speed that enables the engine to be started up, and this may cause the startup characteristics to deteriorate.

Thus, according to the oil passage structure that has been proposed in Patent Document 1, a first oil relief passage that communicates the oil passage that is downstream of the oil pump and the oil pan, and a second oil relief passage that is parallel thereto are provided. An oil relief valve that opens when the hydraulic pressure inside the oil passage becomes equal to or greater than a set value is provided on the first oil relief passage, and an oil relief passage opening and closing valve that opens due to temperature and a startup signal is provided on the second oil relief passage.

Due to having this type of structure, the oil relief passage opening and closing valve opens during low temperatures when the viscosity of the oil becomes high, and a portion of the oil is returned to the oil pan via the second oil relief passage. Thus, the load that is applied to the oil pump is reduced because the hydraulic pressure downstream of the oil pump becomes low.

Furthermore, the proposal of Patent Document 2 is one that improves the proposal according to Patent Document 1. Patent Document 2 discloses an oil passage structure for an engine in which, even if there is a change in the oil viscosity that accompanies a change in temperature, the load on the oil pump is reduced while ensuring the minimum hydraulic pressure that is necessary for a normal startup, and the startup characteristics are improved. Specifically, an oil passage structure for an engine that is provided with a first oil relief passage that communicates the oil passage downstream of the oil pump and the oil pan and a second oil relief passage that is parallel thereto, and an oil relief valve that opens when the hydraulic pressure in the oil passage becomes equal to or greater than a set hydraulic pressure is provided on the first oil relief passage and an oil relief passage opening and closing valve that opens due to a startup signal is provided on the second oil relief passage, wherein the second oil relief valve serial to the oil relief passage opening and closing valve is provided on the second oil relief passage, and the valve opening pressure of this second oil relief valve is set so as to be lower than the valve opening pressure of the oil relief valve that is provided on the first oil relief passage and this second oil relief valve opens due to a hydraulic pressure that is equal to or greater than a minimum hydraulic pressure that is necessary during a startup.

Due to this type of structure, the oil relief passage opening and closing valve that is provided on the second oil relief passage is opened, and during a low temperature startup, the load that is applied to the oil pump can be reduced by lowering the hydraulic pressure downstream of the oil pump. In addition, because the opening of the second relief valve is carried out by a hydraulic pressure that is equal to or greater than a minimum hydraulic pressure that is necessary during startup, even when there is a change in the viscosity of the oil, the oil does not return to the oil pan excessively, and the amount of oil that is necessary during a startup is ensured.

However, piston jets are one among the various mechanisms that are incorporated into an engine that appropriately cool the parts of the engine after a warm-up has been completed. These inject oil toward the piston that is in operation to realize cooling of the area around the piston. These piston jets operate such that when the hydraulic pressure inside the oil passage becomes equal to or greater than a predetermined value, nozzles that face the pistons open and oil is injected.

Patent Document 1: Japanese Unexamined Utility Model Application Publication No. 55-135112

Patent Document 2: Japanese Examined Utility Model Application Publication No. 2-34404

DISCLOSURE OF THE INVENTION

Problems to be Solved by the Invention

As explained above, in the lubrication apparatus for an engine that has been proposed in Patent Document 1 and the oil passage structure for an engine that has been proposed in Patent Document 2, regulation is carried out such that the hydraulic pressure in the engine does not exceed a maximum hydraulic pressure by opening an oil relief valve when the hydraulic pressure becomes equal to or greater than a predetermined value. Here, although piston jets are not mentioned in Patent Document 1 and Patent Document 2, considering that an oil relief valve regulates the maximum hydraulic pressure of an oil passage in Patent Document 1 and Patent Document 2, a hydraulic pressure that would activate piston jets would be lower than the valve opening pressure of the oil relief valve.

Thus, when the hydraulic pressure (ejection pressure) increases because the viscosity of the oil is high during a cold startup, the work load of the oil pump increases. If the work load of the oil pump increases, this invites, for example, a deterioration in the fuel economy.

In addition, if the hydraulic pressure increases and the valve opening pressure of the piston jets is attained, oil is injected towards the pistons. However, oil being injected even though the warm-up has not completed invites excessive cooling of the pistons, and this prevents the early completion of the warm-up.

Thus, it is an object of the present invention to provide an engine hydraulic control apparatus that can carry out the cooling of pistons by piston jets after the warm-up has been completed, and can decrease the load on the oil pump and can stop the injection from the piston jets by avoiding increases in the hydraulic pressure during a cold startup.

Means to Solve the Problems

In order to solve such problems, the engine hydraulic control apparatus of the present invention is an apparatus that controls the hydraulic pressure of the engine, and includes an oil pump that draws oil from an oil tank; a piston jet that opens when the hydraulic pressure of the oil that has been drawn by the oil pump reaches a valve opening pressure Qa and injects oil towards a piston through an oil injection path; a relief valve that is disposed on an oil return path, which is different from the oil injection path, and that opens when the hydraulic pressure of the oil that has been drawn by the oil pump reaches a valve opening pressure Qb; and a switching valve that is disposed on the oil return path; characterized in that the valve opening pressure Qb is set to a valve opening pressure that is within a range of the hydraulic pressure that is necessary to ensure the necessary amount of oil required to lubricate the engine and is lower than the valve opening pressure Qa. According to such a structure, even in the case in which the oil viscosity is high during a cold startup and the hydraulic pressure rises, a reduction in the friction and a reduction in the load on the oil pump are realized because the relief valve is opened and the oil is released when a predetermined hydraulic pressure Qb is attained. In addition, oil is not injected from the piston jets toward the pistons and the early completion of the warm-up is not hindered. In addition, by setting the valve opening pressure Qb within a range that is equal to or greater than a prescribed necessary hydraulic pressure, it is possible to prevent an insufficient amount of oil from being supplied to each of the lubricated parts. Note that the oil tank may be an oil pan that is installed below the cylinder block, or may be a separate tank.

Here, the switching valve can be a thermostat that opens during low temperature and enables the oil in the oil return path to flow. If a thermostat is used, the switching valve is opened during low temperatures, when the viscosity of the oil becomes high, and it can raise the hydraulic pressure by closing when the hydraulic pressure has risen as the warm-up progresses. If the hydraulic pressure rises and a valve opening pressure Qa is attained, oil is injected from the piston jets, and the pistons can be cooled.

If a thermostat is used in this manner, it is possible to open and close the switching valve depending on the oil temperature, but the switching valve can be structured such that the opening and closing operation is carried out depending on the engine speed and the engine load. For example, the switching valve can be structured so as to use a solenoid or the like that is controlled by an ECU (electronic control unit), and carry out the opening and closing operation based on opening and closing commands that depend on the engine speed and the engine load. Note that such a switching valve can refer to various types of values for the engine speed, the engine load and the like in order to carry out opening and closing operation at an appropriate timing. These values can be referred to singly or in appropriate combinations to determine the opening and closing timing. These values are conventionally acquired from various types of sensors that are provided in the engine or the vehicle. For example, it is possible to determine the engine load by the fuel injection rate or the accelerator opening angle.

Furthermore, such a switching valve is structured such that the switching valve is closed when it has been determined that the engine is in an operating state that requires an amount of oil by referring to the engine speed and the engine load. For example, even when the engine speed is low, the switching valve is closed when the engine load is high so that oil is supplied to each of the lubricated parts. In addition, even in the case in which the speed is low and the load is low, the switching valve is closed when the oil temperature is high, and it is possible to inject oil from the piston jets.

Furthermore, it is possible to structure the switching valve such that the opening and closing operation is carried out by referring to an estimated oil amount, which is estimated by a circulating oil amount estimating means, and it is possible to structure this circulating oil amount estimating means, for example, by an ECU or the like such that the estimated oil amount is calculated based on a hydraulic pressure value that has been acquired by a hydraulic pressure measuring means such as an oil pressure gauge, an oil temperature value that has been acquired by an oil temperature measuring means such as an oil temperature gauge, and the pumping speed. According to such a structure, it is possible to maintain a hydraulic pressure that does not, as far as possible, apply a load to the oil pump while avoiding a state in which the parts that are lubricated have insufficient oil, and it is possible to realize a reduction in the friction and a reduction in the load of the oil pump.

In addition, in the engine hydraulic control apparatus that has such a structure, it is possible to structure the switching valve such that the valve opening operation is stopped when the hydraulic pressure value has not attained a hydraulic pressure value that has been estimated based on the oil temperature value and the pumping speed. When the measured hydraulic pressure value has not attained the estimated hydraulic pressure value, it can be assumed that some sort of damage has occurred and the switching valve is not operating normally, or that the oil has been degraded or become thinned or the like. Thus, the switching valve is closed so that the necessary amount of the oil supply to each of the lubricated parts is not delayed, and the oil that has been drawn by the oil pump cannot return through the oil return path. At this time, a warning such as lighting a lamp may be carried out so as to inform the driver about the abnormality. In addition, simultaneously, it is possible to carry out control in which the engine speed is suppressed to protect the engine.

Effects of the Invention

According to the present invention, because the valve opening pressure Qb of the relief valve is set to a valve opening pressure that is within a range of necessary hydraulic pressure that can ensure the necessary amount of oil that is required to lubricate the engine and is lower than the valve opening pressure Qa of the piston jets, the relief valve opens before oil is injected by the piston jets when the hydraulic pressure rises accompanying the viscosity of the oil becoming high during a cold startup of the engine, and it is possible to realize a reduction in the friction and a reduction in the load of the oil pump by reducing the hydraulic pressure and to avoid carrying out the injection of oil even though the temperature is low.

BEST MODES FOR CARRYING OUT THE INVENTION

Below, the best modes for carrying out the present invention will be explained in detail with reference to the drawings.

First Embodiment

Figure 1:
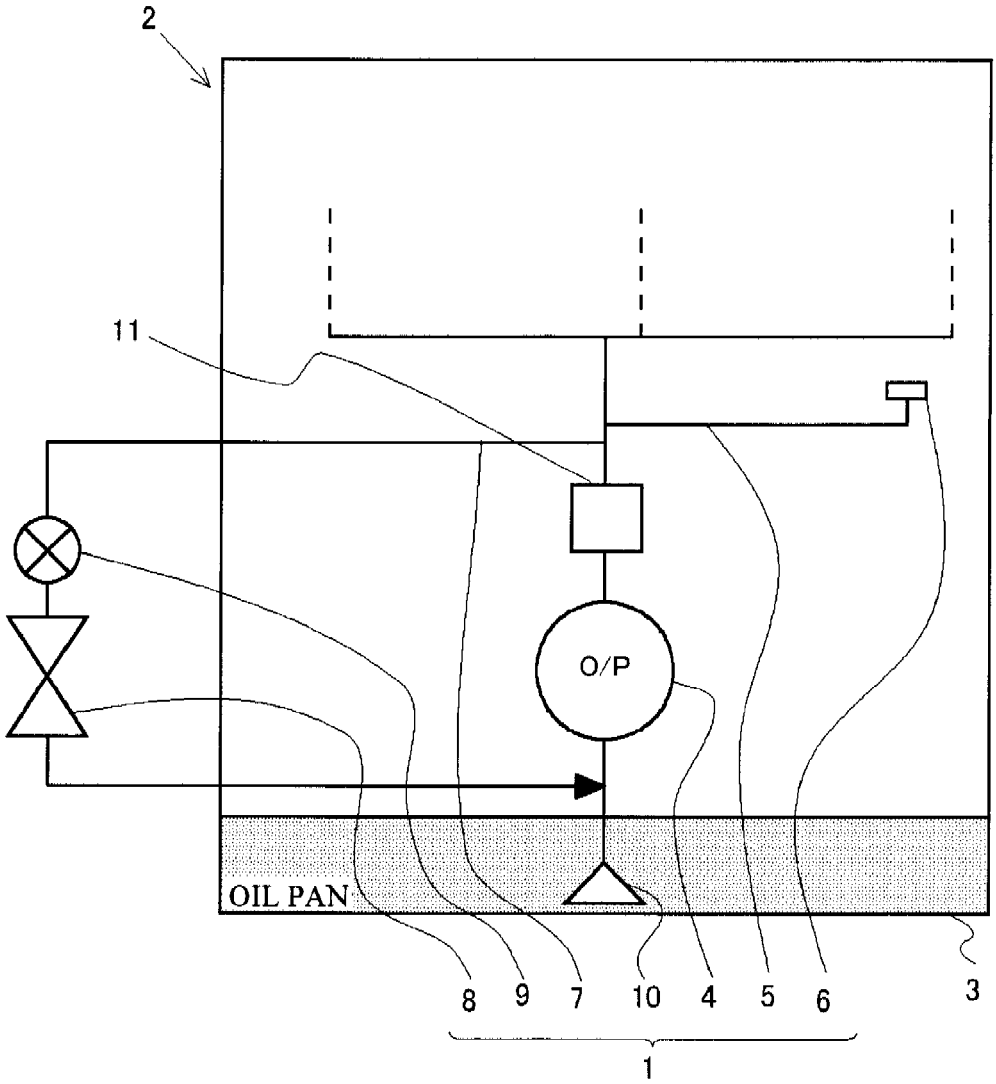
FIG. 1 is a schematic drawing that shows the schematic structure of an engine that incorporates therein the hydraulic control apparatus of the first embodiment.
Figure 2:
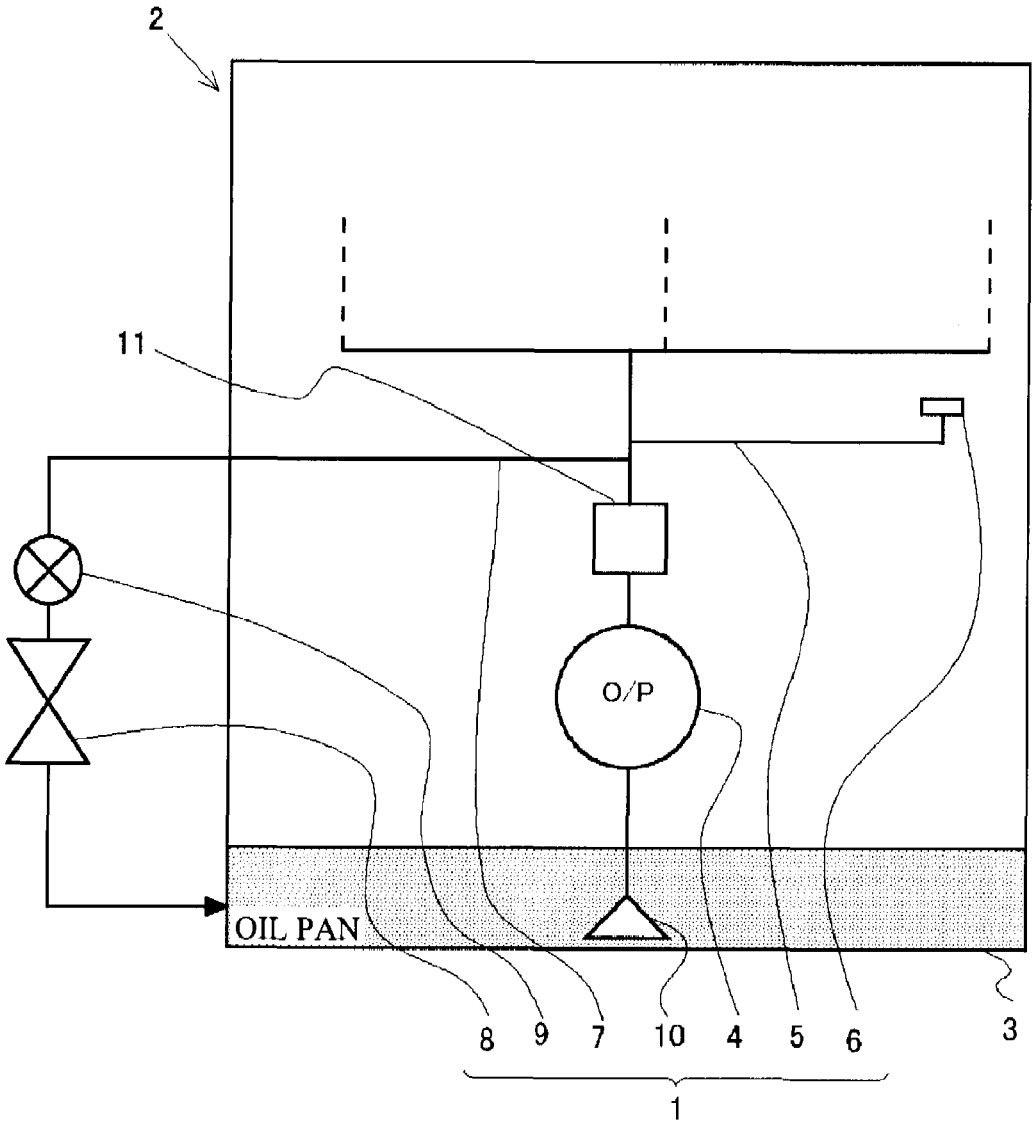
FIG. 2 is a schematic drawing of the embodiment in which the downstream end of the oil return path is connected to the oil pan.

FIG. 1 is a schematic drawing that shows the schematic structure of an engine 2 that incorporates the hydraulic control apparatus 1 of the present invention. The hydraulic control apparatus 1 includes an oil pump 4 that draws oil from an oil pan 3 due to the rotation of the crankshaft; a piston jet 6 that opens when the hydraulic pressure of the oil that has been drawn by this oil pump 4 attains a valve opening pressure Qa and injects oil towards a piston (not illustrated) through an oil injection path 5; a relief valve 8 that is disposed on an oil return path 7 that is different from the oil injection path 5, and is opened when the hydraulic pressure of the oil that has been drawn by the oil pump 4 attains a valve opening pressure Qb; and a switching valve 9 that is disposed on the oil return path 7. The oil pan 3 corresponds to the oil tank in the present invention. A strainer 10 is disposed on the upstream end portion of the oil pump 4. In addition, the downstream end of the oil return path 7 connects the oil pump 4 and the strainer 10, and the return oil thereby circulates. The returning oil returns along the path of the oil without being poured directly into the oil pan 3, and thus the oil in the oil pan 3 does not foam. Note that because the oil in the oil pan 3 does not foam, as shown in FIG. 2, it is possible to use a structure in which the downstream end of the oil return path 7 is connected to a position that is lower than the oil surface of the oil pan 3.

In addition, as shown in the figure, an oil filter 11 is installed downstream of the oil pump 4. The oil injection path 5 and the oil return path 7 divide downstream of this oil filter 11. Due to having such a structure, the flow of contaminants into the switching valve 9 is prevented, and malfunctions due to jamming that is caused by contaminants is prevented. Note that it is also possible to use a structure that can realize a reduction in the friction of the oil pump 4 and an improvement in fuel economy by dividing the oil injection path 5 and the oil return path 7 upstream of the oil filter 11, and releasing the oil to the oil return path 7 before pressure loss increases.

A relief valve 8 in a hydraulic control apparatus 1 that has such a structure opens when the hydraulic pressure in the path attains a predetermined valve opening pressure Qb. This valve opening pressure Qb is set to a valve opening pressure that is within a range of the necessary hydraulic pressure that can ensure the necessary amount of oil that is required for lubricating the engine 2 and is lower than the valve opening pressure Qa of the piston jet 6.

In addition, the switching valve 9 is a thermostat, detects the oil temperature by a thermosensitive portion, and opens during low temperature so that oil that has been drawn by the oil pump 4 flows to the oil return path 7 side.

Figure 3:
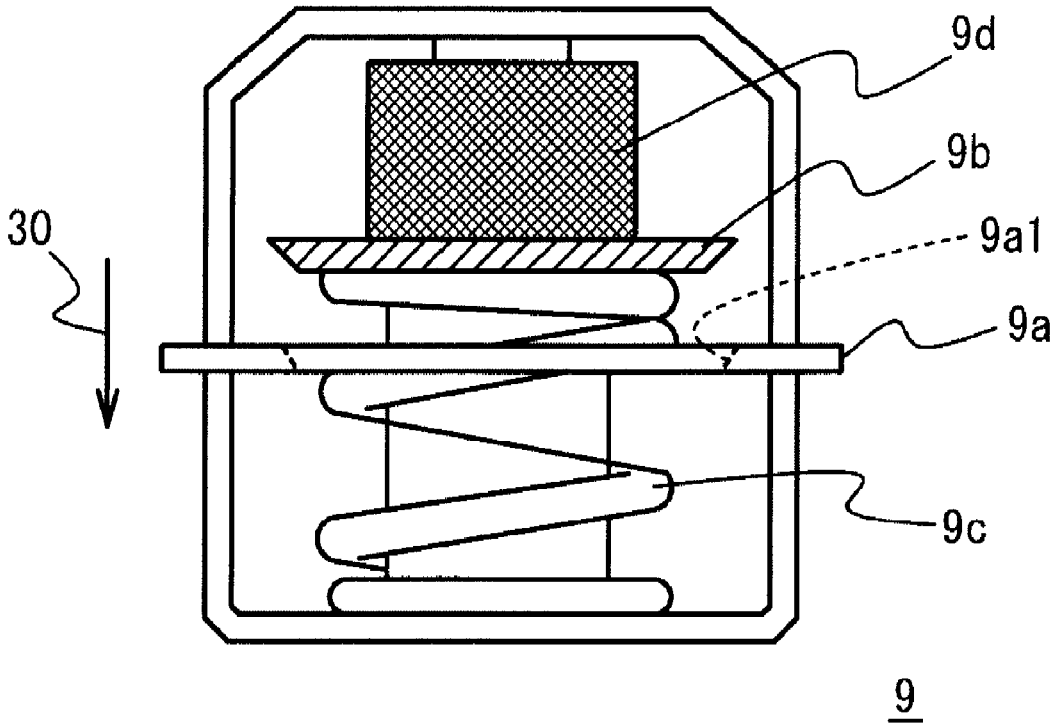
FIG. 3 is an explanatory diagram of a thermostat, which serves as the switching valve.

The specific structure of this switching valve 9 is shown in FIG. 3. The switching valve 9 is one in which a valve body 9*b* is opened and closed by being pressed toward or separated from a hole 9*a*1 that is provided in the plate body 9*a*. The switching valve 9 is structured by being provided on one side of the valve body 9*b* with a spring 9*c* that urges the valve body 9*b* in a direction that opens the hole 9*a*1, and being provided on the other side of the valve body 9*b* with a piston 9*d* that contains thermowax. In the switching valve 9 having such a structure, when this thermowax expands accompanying a rise in temperature in the vicinity thereof, the piston 9*c* presses the valve body 9*b* down in the direction of an arrow 30 to close the hole 9*a*1.

Specifically, in the switching valve 7, until reaching the temperature at which the thermowax expands, the valve body 9*b*, which is urged by the spring 9*c*, opens the hole 9*a*1, and when the temperature rises and the piston 9*c* is pressed down due to the thermowax expanding, the valve body 9*b* closes the hole 9*a*1.

Next, the operation of the hydraulic control apparatus 1 that is structured as described above will be explained. When the engine 2 is started up while cold and the crankshaft starts rotating, the oil pump 4 starts operation, and oil that is in the oil pan 3 is drawn. At this time, the viscosity of the oil is high because its temperature is low. In this manner, when the temperature of the oil is low, the switching valve 9, which is a thermostat, is opened. In addition, when the oil pressure is not very high immediately after the engine startup, the relief valve 8 is closed. Thus, the oil is blocked by the relief valve 8.

When the oil pump 4 operates continuously, the oil pressure gradually rises, and when the oil pressure reaches the valve opening pressure Qb, which is the valve opening pressure of the relief valve 8, the relief valve 8 opens. Thereby, the oil pressure in the path is reduced, the friction of the oil pump 4 is also reduced, and the load is reduced. In addition, at the point in time that the valve opening pressure Qb has been reached, the relief valve 8 is opened, and thus hydraulic pressure does not rise any further, and the valve opening pressure Qa of the piston jet 6 is not reached. Thus, oil is not injected towards the piston, and a quick warm-up of the engine 2 is not hindered, even though the state is cold.

In contrast, when the warm-up has completed and the hydraulic pressure rises, the switching valve 9 closes, and the flow of the oil in the oil return path 7 is blocked. Thereby, the hydraulic pressure in the path exceeds the valve opening pressure Qb of the relief valve 8, and the hydraulic pressure rises. When the raised hydraulic pressure attains the valve opening pressure Qa of the piston jet, oil is injected from the piston jet 6 toward the piston, and the area around the piston is cooled.

Second Embodiment

Figure 4:
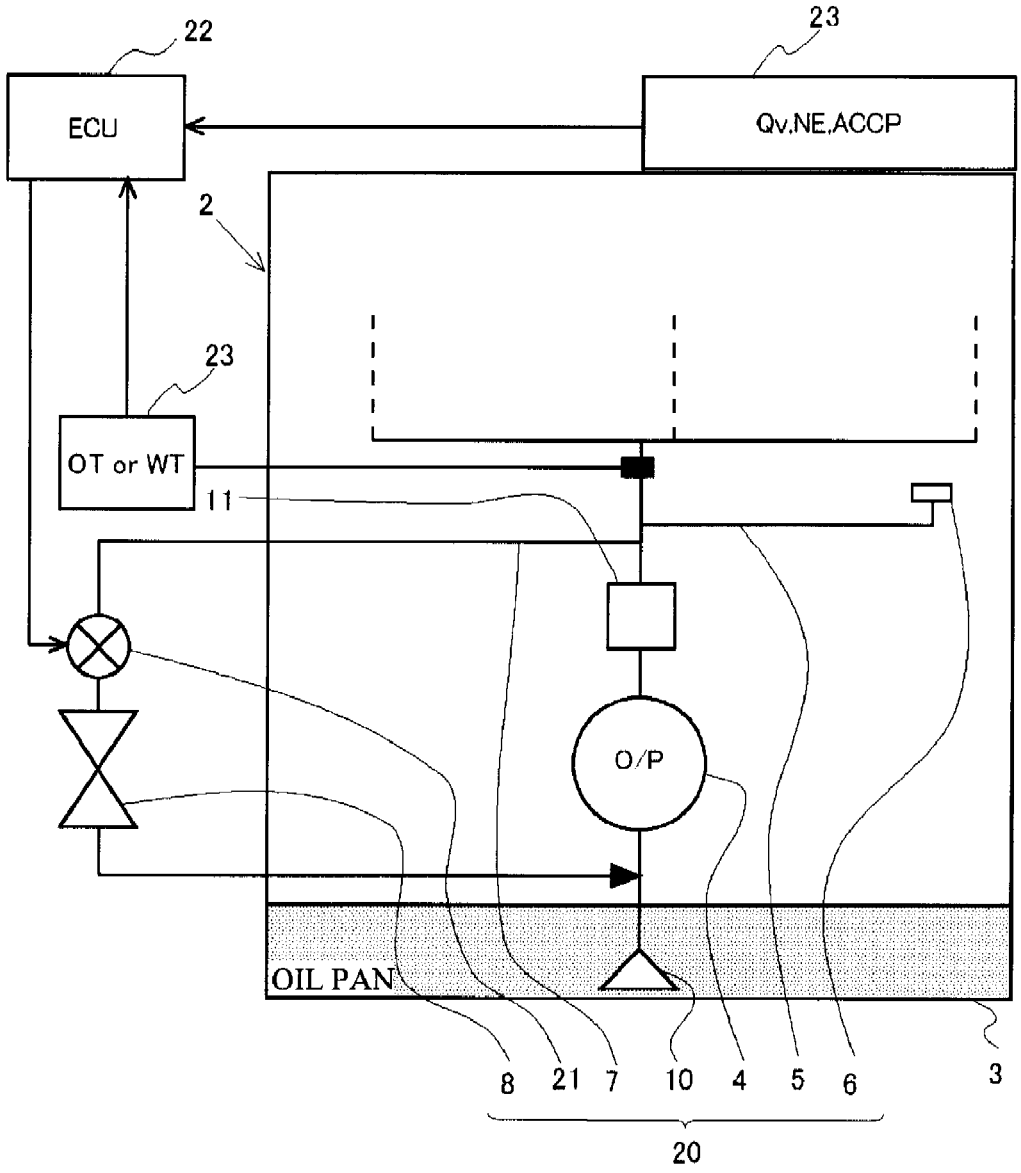
FIG. 4 is a schematic drawing that shows the schematic structure of an engine that incorporates the hydraulic control apparatus of the second embodiment.

Next, a second embodiment of the present invention will be explained with reference to FIG. 4. The point on which a hydraulic control apparatus 20 that is shown in FIG. 4 differs from the hydraulic control apparatus 1 of the first embodiment is that, in the hydraulic control apparatus 1 in the first embodiment, the switching valve 9 is a thermostat that carries out opening and closing by detecting the oil temperature, while in contrast, in the hydraulic control apparatus 20 of the second embodiment, a switching valve 21 uses an electromagnetic solenoid that is controlled by an ECU 22, which executes opening and closing commands based on data that has been obtained from a sensor group 23. Other structures do not differ from those of the hydraulic control apparatus 1 of the first embodiment, and thus identical reference numerals are attached to identical elements in the figures, and the explanations thereof are omitted.

The switching valve 21 of such a hydraulic control apparatus 20 carries out the opening and closing operation depending on the engine load based on the engine speed NE, the fuel injection rate Qv, and the accelerator opening angle ACCP. In the ECU 22, a plurality of maps are prepared that are selected depending on the operating conditions, the appropriate map is selected by analyzing the acquired data, and the opening and closing control of the switching valve 21 is carried out. The basic method for the control of the switching valve 21 is one in which the switching valve 21 is closed when it has been determined that the engine is in an operating state that requires an amount of oil by referring to the engine speed and the engine load, and the oil is supplied to each of the lubricated parts. Below, an example of the switching valve opening and closing control during a cold startup and after the warm-up has completed will be shown.

Figure 5:
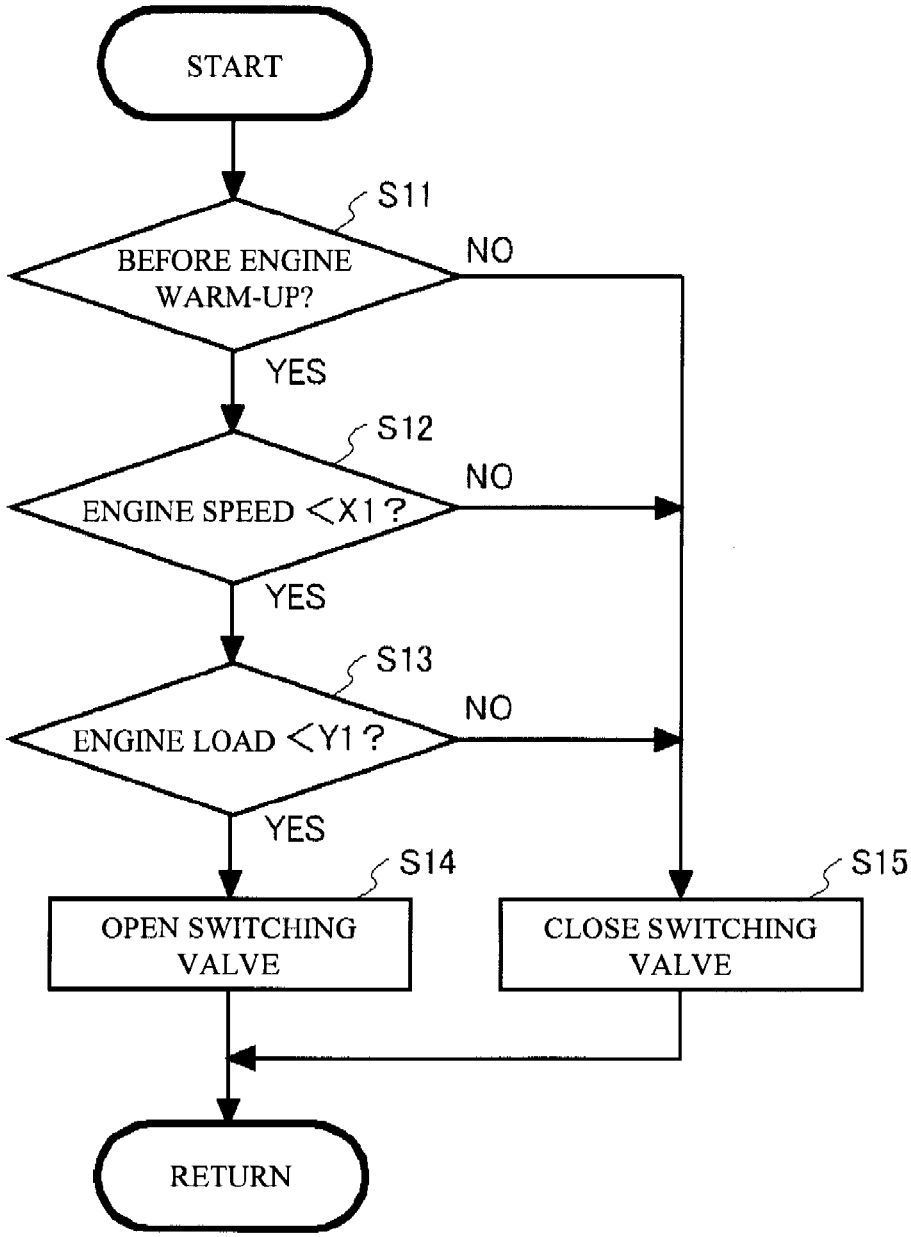
FIG. 5 is a flowchart that shows an example of the switching valve opening and closing control in the hydraulic control apparatus of the second embodiment.

FIG. 5 is a flowchart that shows the switching valve opening and closing control during a cold startup. When the engine 2 starts up, the ECU 22 determines whether the engine 2 is in a pre-warm-up state by acquiring the oil temperature OT ant the water temperature WT from the oil temperature gauge and the water temperature gauge that are included in the sensor group 23 (step S11). When it has been determined that step S11 is YES, that is, when it has been determined that the engine 2 is in a pre-warm-up state, the processing proceeds to step S12. In step S12, the ECU 22 determines whether or not the engine speed NE has attained a value X1 that is recorded in a map. When it has been determined that step S12 is YES, that is, when it has been determined that the engine speed NE has not attained the value X1, the processing proceeds to step S13. In step S13, it is determined whether or not the engine load, which is found from the fuel injection rate Qv and the accelerator opening angle ACCP, has attained a value Y1 that is recorded in a map. In the case in which it has been determined that step S13 is YES, that is, when it has been determined that the engine load has not attained the value Y1, the processing proceeds to step S14. In step S14, the ECU 22 opens the switching valve 21. Thereby, the rise of the hydraulic pressure in the path is suppressed, and it is possible to realize a reduction in the friction and the load on the oil pump 4, and to realize an improvement in the fuel economy.

In contrast, when it has been determined that step S11, step S12, and step S13 are NO, in all cases the switching valve 21 is closed (step S15). In the case in which the measures in step S15 are taken, because all cases are an operating state in which it is determined that an amount of oil is necessary in each of the lubricated parts, the switching valve 21 is closed and oil is supplied to each of the lubricated parts. Note that the switching valve 21 is closed when no control is being carried out, that is, when the electromagnetic solenoid is not being charged. This is a measure for supplying oil to each of the lubricated parts even in the case in which some sort of abnormality has occurred in the control system or the like and the switching valve 21 does not operate.

Figure 6:
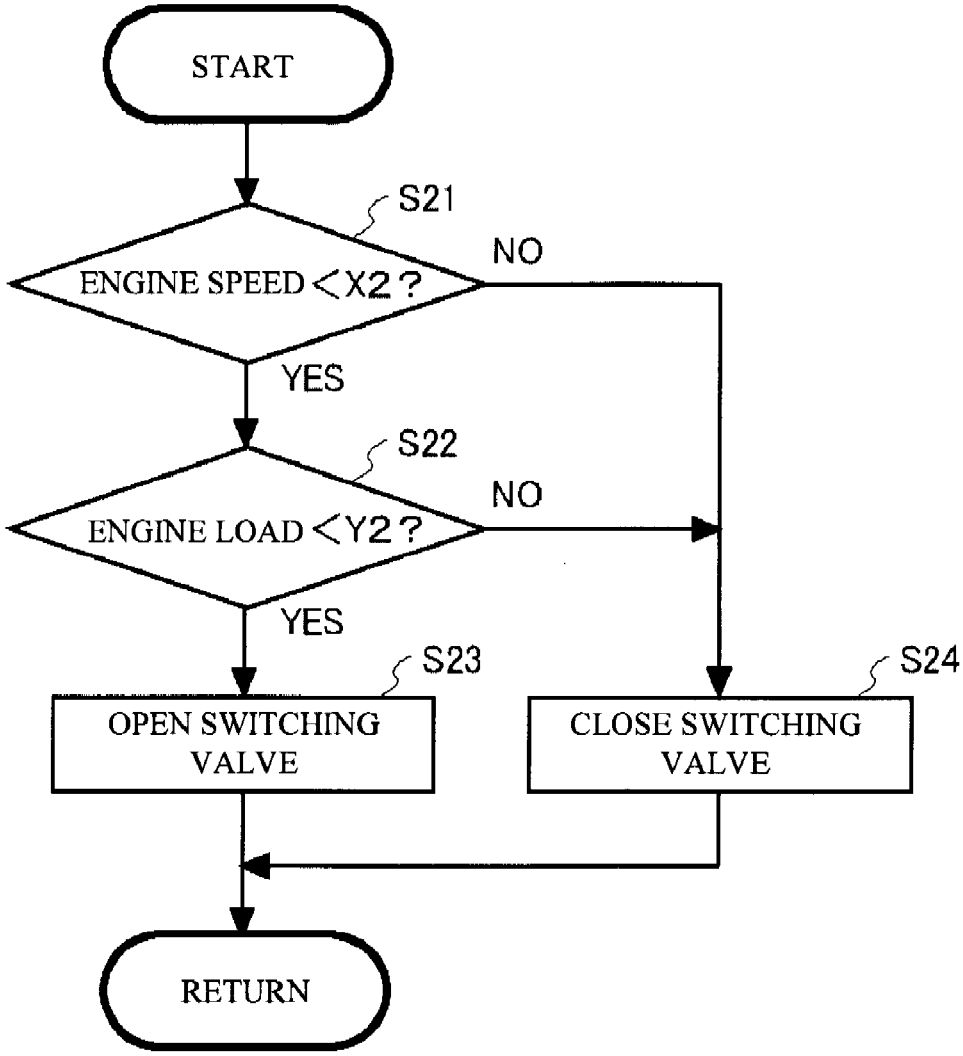
FIG. 6 is a flowchart that shows an example of an alternative switching valve opening and closing control.

Next, the switching valve opening and closing control after the completion of the warm-up will be explained with reference to the flowchart that is shown in FIG. 6. The warm-up completes, and when a map used after the warm-up completion has been selected, in step S21, the ECU 22 determines whether or not the engine speed NE has attained the value X2, which is recorded in the map. When it has been determined that step S21 is YES, that is, when it has been determined that the engine speed NE has not attained the value X2, the processing proceeds to step S22. In step S22, it is determined whether or not the engine load, which is found based on the fuel injection rate Qv and the accelerator opening angle ACCP, has attained that value Y2, which is recorded in a map. In the case in which it has been determined that step S22 is YES, that is, when the engine load has not attained the value Y2, the processing proceeds to step S23. In step S23, the ECU 22 opens the switching valve 21. Thereby, a rise in the hydraulic pressure in the path is suppressed, and it is possible to realize a reduction in the friction and the load on the oil pump 4, and to realize an improvement in fuel economy.

In contrast, when it has been determined that step S21 and step S22 are NO, in all cases, the switching valve 21 is closed (step S24). In the case in which the measures in step S24 are taken, because all cases are operating states in which it is determined that an amount of oil is necessary for each of the lubricated parts, the switching valve 21 is closed and oil is supplied to each of the lubricated parts.

The embodiments described above are simply examples for carrying out the present invention, and the present invention is not limited thereby. These examples can be variously modified within the scope of the present invention, and furthermore, within the scope of the present invention, it is obvious that various alternate examples are possible.

Note that the following summarizes the effects of the hydraulic control apparatus of the present invention. First, it is possible to realize a reduction in the friction of the oil pump when cold by releasing the oil that has been drawn by the oil pump by using the relief valve, and it is possible to realize an improvement in the fuel economy by promoting a reduction in the sliding friction by stopping the injection of the piston jets in order to raise the temperature of the pistons and bores. In addition, because it becomes possible to carry out the oil injection by the piston jets appropriately, it is possible to stabilize the combustion by raising the temperature of the pistons and bores, suppress misfiring at low temperatures, and suppress the discharge of emissions (HCs). Furthermore, an improvement in the engine startup characteristics during extreme cold can be expected because the friction of the oil pump is decreased. In addition, because it is possible to make the amount of the engine lubricating oil small, it is possible to increase the level of reliability with respect to an insufficiency in the amount of the lubricating oil during extremely cold temperatures.

The invention claimed is:

1. An engine hydraulic control apparatus, which is an apparatus that controls the hydraulic pressure of an engine, comprising:

an oil pump that draws oil from an oil tank;

a piston jet that opens when the hydraulic pressure of oil that has been drawn by the oil pump attains a valve opening pressure Qa, and injects oil towards a piston through an oil injection path;

a relief valve that is disposed on an oil return path that differs from the oil injection path, and that opens when the hydraulic pressure of the oil that has been drawn by the oil pump attains a valve opening pressure Qb; and a switching valve that is disposed on the oil return path, wherein:

the valve opening pressure Qb is set to the valve opening pressure that is within a range of the necessary hydraulic pressure that can ensure the necessary amount of oil that is required for the lubrication of the engine and is lower than the valve opening pressure Qa;

the switching valve carries out the opening and closing operation by referring to an estimated oil amount that is estimated by circulating oil amount estimating means; and the circulating oil amount estimating means calculates the estimated oil amount based on a hydraulic pressure value that has been obtained by hydraulic pressure measuring means, an oil temperature value that has been obtained from oil temperature measuring means, and the pumping speed.

2. An engine hydraulic control apparatus according to claim 1, wherein the switching valve stops the valve opening operation when a hydraulic pressure value has not attained a hydraulic pressure value that has been estimated based on the oil temperature value and the pumping speed.

* * * * *